US009643626B2

(12) United States Patent
Wolf et al.

(10) Patent No.: US 9,643,626 B2
(45) Date of Patent: May 9, 2017

(54) RAIL VEHICLE UNIT

(71) Applicant: Bombardier Transportation GmbH, Berlin (DE)

(72) Inventors: Andreas Wolf, Winterthur (CH); Michael Wusching, Wilthen (DE); Cedric Zanutti, Sart-Eustache (BE)

(73) Assignee: Bombardier Transportation GmbH, Berlin (DE)

( * ) Notice: Subject to any disclaimer, the term of this patent is extended or adjusted under 35 U.S.C. 154(b) by 111 days.

(21) Appl. No.: 14/403,781

(22) PCT Filed: May 29, 2013

(86) PCT No.: PCT/EP2013/061134
§ 371 (c)(1),
(2) Date: Nov. 25, 2014

(87) PCT Pub. No.: WO2013/178718
PCT Pub. Date: Dec. 5, 2013

(65) Prior Publication Data

US 2015/0096457 A1 Apr. 9, 2015

(30) Foreign Application Priority Data

May 30, 2012 (EP) ..... 12170114

(51) Int. Cl.
*B61F 5/12* (2006.01)
*B61F 5/00* (2006.01)

(52) U.S. Cl.
CPC . *B61F 5/12* (2013.01); *B61F 5/00* (2013.01)

(58) Field of Classification Search
CPC ..... B61F 3/04; B61F 5/24; B61F 5/08; B61F 5/12; B61F 5/00; B61F 5/125; B61F 5/38; B61F 5/148
USPC ..... 105/199.1, 158.2
See application file for complete search history.

(56) References Cited

U.S. PATENT DOCUMENTS

| | | | |
|---|---|---|---|
| 2,861,522 | A | 11/1958 | Rossell |
| 2,885,970 | A | 5/1959 | Heumann |
| 2,954,747 | A | 10/1960 | Hirst et al. |
| 2,981,208 | A | 4/1961 | Sinclair |
| 3,387,569 | A | 6/1968 | Lich |

(Continued)

FOREIGN PATENT DOCUMENTS

| | | | |
|---|---|---|---|
| CN | 2515076 | Y | 10/2002 |
| CN | 202413825 | U | 9/2012 |

(Continued)

*Primary Examiner* — Mark Le
(74) *Attorney, Agent, or Firm* — The Webb Law Firm

(57) ABSTRACT

A rail vehicle unit, having a running gear and a wagon body unit. The wagon body unit is supported on the running gear via a suspension device, a first rotational buffer device and a second rotational buffer device being associated to the running gear and the wagon body unit. The first rotational buffer device and the second rotational buffer device are adapted to damp a rotational motion between the running gear and the wagon body unit about a rotational axis parallel to the height direction. The first rotational buffer device and the second rotational buffer device are configured to form a traction link between the running gear and the wagon body unit.

16 Claims, 4 Drawing Sheets

(56) References Cited

U.S. PATENT DOCUMENTS

| | | | | | |
|---|---|---|---|---|---|
| 3,547,045 | A | * | 12/1970 | Cunningham | B61F 5/08 105/199.1 |
| 3,547,046 | A | * | 12/1970 | Lich | B61F 3/04 105/136 |
| 3,952,669 | A | | 4/1976 | Mauzin et al. | |
| 4,233,910 | A | * | 11/1980 | Schumacher | B61F 5/386 105/168 |
| 4,760,799 | A | | 8/1988 | Jackson et al. | |
| 4,998,997 | A | | 3/1991 | Carlston | |
| 2010/0011985 | A1 | | 1/2010 | Bieker et al. | |

FOREIGN PATENT DOCUMENTS

| | | | | |
|---|---|---|---|---|
| DE | 2313887 | A1 | | 10/1973 |
| DE | 4136926 | A1 | | 5/1993 |
| DE | 4214066 | A1 | | 11/1993 |
| DE | 4428038 | C1 | | 8/1995 |
| FR | 2490171 | A1 | | 3/1982 |
| GB | 1124790 | | | 8/1968 |
| JP | 1-136868 | | * | 5/1989 |

* cited by examiner

RAIL VEHICLE UNIT

CROSS-REFERENCE TO RELATED APPLICATIONS

This application is the United States national phase of International Application No. PCT/EP2013/061134 filed May 29, 2013, and claims priority to European Patent Application No. 12170114.8 filed May 30, 2012, the disclosures of which are hereby incorporated in their entirety by reference.

BACKGROUND OF THE INVENTION

Field of the Invention

The present invention relates to a rail vehicle unit comprising a running gear and a wagon body unit forming two contact partners and defining a longitudinal direction, a transverse direction and a height direction. The wagon body unit is supported on the running gear via a suspension device, wherein a first rotational buffer device and a second rotational buffer device are associated to the running gear and the wagon body unit. The first rotational buffer device and the second rotational buffer device are adapted to damp a rotational motion between the running gear and the wagon body unit about a rotational axis parallel to the height direction.

Description of Related Art

Such rail vehicle units are well known in the art. Typically, such rail vehicle units have one or more traction linkage elements connected to the running gear frame and the wagon body in order to be able to transmit traction forces between the running gear and the wagon body during accelerating and braking. Conventionally, such traction linkage elements are comparatively short, longitudinally rigid elements cardanically connected to the running gear frame and the wagon body, as it is known, for example, known from DE 41 36 926 A1 (the entire disclosure of which is incorporated herein by reference).

However, in particular in modern low floor rail vehicles, there is very few space available in the area of the running gear to properly place such traction linkage elements. Moreover, due to the relative motion between the wagon body and the running gear during operation, such traction linkage elements require an additional amount of space for being able to execute their motion. Finally, in addition, due to the fact that an increasing number of active components are to be received within the limited space of the running gear, in many cases there is very little space available at favorable locations for introducing the traction forces. Rather, space for placing such traction linkage elements typically is more readily available at less favorable locations, such that the traction forces (and the stresses they cause within the affected components) have to take a long way through the running gear structure (ultimately from the point of wheel to rail contact) up to the point where the traction linkage element leads them into the wagon body.

SUMMARY OF THE INVENTION

Thus, it is the object of the present invention to provide a rail vehicle unit as described above, which does not show the disadvantages described above, or at least shows them to a lesser extent, and which, in particular, facilitates a more space-saving configuration relaxing the building space constraints within the running gear.

The present invention is based on the technical teaching that a more space-saving configuration relaxing the building space constraints within the running gear can be accomplished, if the rotational buffer devices are modified to integrate, as a further function, the ability to form a traction link between the running gear and the wagon body unit. More precisely, it has turned out that in many cases, in particular in vehicles where a low rotational deflection between the running gear and the wagon body is to be expected during normal operation on curved tracks, only a comparatively narrow gap or small play is necessary for allowing (at least less constrained) rotational deflection before the rotational buffer devices become increasingly effective. Hence, it has been shown that the ability of such rotational buffer devices to transmit considerable forces between the running gear the wagon body may also be used for transmitting traction forces without having any noticeable loss in riding comfort due to a late onset of the traction force transmission, since due to the comparatively narrow gap as outlined above, noticeably late onset of the traction force transmission is avoided.

Hence, according to the invention, at least a considerable fraction of the total traction force to be transmitted between the running gear and the wagon body unit is taken by the rotational buffer devices. This functional integration of the transmission of traction forces within the rotational buffer devices at least leads to a reduction in the number and/or size of additional traction linkage elements. Moreover, it has been shown that it is even possible to completely avoid the use of such additional traction linkage elements, which greatly relaxes the building space constraints within the running gear.

Hence, according to one aspect, the present invention relates to a rail vehicle unit, comprising a running gear and a wagon body unit forming two contact partners and defining a longitudinal direction, a transverse direction and a height direction. The wagon body unit is supported on the running gear via a suspension device, wherein a first rotational buffer device and a second rotational buffer device are associated to the running gear and the wagon body unit. The first rotational buffer device and the second rotational buffer device are adapted to damp a rotational motion between the running gear and the wagon body unit about a rotational axis parallel to the height direction. The first rotational buffer device and the second rotational buffer device are configured to form a traction link between the running gear and the wagon body unit, the traction link being configured to transmit at least a major fraction of a total traction force to be transmitted along the longitudinal direction between the running gear and the wagon body unit.

As mentioned above, the traction link formed by the first and second rotational buffer device is configured to transmit at least a major or considerable fraction of the total traction force to be transmitted between the running gear and the wagon body unit (more precisely, the maximum total traction force to be transmitted between the running gear and the wagon body during normal operation of the rail vehicle unit at nominal loading). It should be noted that, depending on the design of the suspension device (typically a secondary suspension device), in some cases a certain fraction of the total traction force to be transmitted between the running gear and the wagon body is already transmitted via the suspension device (due to the rigidity of the suspension device in the longitudinal direction).

Hence, preferably, the traction link formed by the first and second rotational buffer device is configured to transmit at least 50%, preferably at least 75%, more preferably 90%, even more preferably substantially 100%, of a remaining fraction of the total traction force, the remaining fraction being the difference between the total traction force and a suspension fraction of the total traction force which is already transmitted by the suspension device along the longitudinal direction. In other words, depending on the fraction of the transmitted by the first and second rotational buffer device, further components, such as one on more traction link elements, may be provided in addition. Preferably, however, the traction link formed by the first and second rotational buffer device is configured to take substantially the entire remaining fraction of the total traction force, such that additional traction link elements may be dispensed with.

With certain preferred embodiments of the invention, at least one of the first rotational buffer device and the second rotational buffer device is connected to a first contact partner of the two contact partners, at least one of the first rotational buffer device and the second rotational buffer device having a first contact surface, a second contact surface being formed at a second contact partner of the two contact partners. The first contact surface and the second contact surface are configured to contact each other to transmit the fraction of the total traction force between the running gear and the wagon body unit. The first contact surface and the second contact surface, in a neutral state of the rail vehicle unit (i.e. with the rail vehicle standing on a straight, level track), are separated by a longitudinal gap having a longitudinal gap dimension in the longitudinal direction.

Hence, and these embodiments in such a neutral state, the two contact surfaces are in very close proximity (in the longitudinal direction) but do not contact each other. This has the advantage that wear of the contact surfaces is reduced and, furthermore, the first and second rotational buffer devices, at least initially, do not counteract angular deflection of the wagon body unit with respect to the running gear (about the rotational axis). At a certain deflection between the running gear and the wagon body unit in the longitudinal direction the two contact surfaces contact each other, thereby starting traction force transmission in the longitudinal direction via the contact surfaces (i.e. via the respective rotational buffer device).

Generally, any desired initial gap may be chosen which is sufficiently narrow to avoid a delay of the onset of traction force transmission which would be noticeable and felt to be annoying by the passengers of the vehicle (e.g. as a noticeably abrupt longitudinal acceleration). With preferred embodiments of the invention, the longitudinal gap dimension, is less than 3 mm, preferably less than 2 mm, more preferably substantially 0 mm to 1 mm, since such a configuration provides acceptable angular deflection between the running gear and the wagon body unit while maintaining good riding comfort (by avoiding noticeable delays in the onset of traction force transmission).

It should be noted however that, with other embodiments of the invention, permanent contact between the first and second contact surface may be provided. In these cases, preferably, the respective rotational buffer device includes a comparatively longitudinally soft component (i.e. a component having a rigidity which is considerably lower in the longitudinal direction than the rigidity of the remaining parts of the rotational buffer device). Such a longitudinally soft component may allow initial, generally unrestricted deflection between the running gear and the wagon body up to the onset of the remaining, more rigid parts of the rotational buffer device. For example, such a soft component may be deformed up to the point where its deformation potential is exhausted. At this point in time, the remaining, more rigid parts of the rotational buffer come become noticeably effective.

Basically, the first and second rotational buffer devices may have any desired and suitable spatial arrangement within the rail vehicle unit to achieve formation of the traction link. Preferably, the first contact partner is formed by the running gear, while the second contact partner is formed by the wagon body unit. In other words, preferably, the respective rotational buffer device with the first contact surface is connected to the running gear while a corresponding second contact surface is formed at the wagon body unit. Such a configuration is beneficial from the manufacturing point of view since the majority of the components responsible for the traction force transmission are connected to the running gear which facilitates convenient pretesting of these components during running gear manufacture.

Furthermore, it is generally preferable to spatially closely associate the rotational buffer devices to traction force introduction areas where the traction forces are introduced into the running gear and into the running gear frame. This has the advantage that, in many cases, it is possible to realize the shortest possible way for the traction forces to be transmitted from the running gear, more precisely, ultimately from the point of wheel to rail contact, to the wagon body unit. In particular, with such a design traction force transmission (unlike in many solutions known in the art) does not take its way through transversally central parts of the running gear frame such as, for example, a transverse beam of a running gear frame. Hence, for example, such a transverse beam may be of a more lightweight and less rigid design. Such a less rigid design, in particular, a reduced torsional rigidity about the transverse direction, is beneficial in terms of riding comfort and derailment safety. This is due to the fact that the running gear frame, through torsional deformation, is more readily available to provide equalization of the wheel to rail contact forces among the wheel units. Hence, ultimately, such a running gear, at least from the point of view of riding comfort and derailment safety, is more forgiving to unfavorable track conditions.

Hence, preferably, the running gear comprises a frame body supported on at least one wheel unit via a primary suspension device and two wheel bearing units, each associated to one wheel of said wheel unit. The wheel unit defines a track width in the transverse direction and a traction force plane, the traction force plane, in a neutral state of the rail vehicle unit, extending through a wheel to rail contact point of one of the wheels and being perpendicular to the transverse direction. The wheel unit further defines a bearing center width between centers of the wheel bearing units in the transverse direction and a bearing center plane, the bearing center plane, in a neutral state of the rail vehicle unit, extending through the center of one of the wheel bearing units and being perpendicular to the transverse direction. Furthermore, the first rotational buffer device has a volumetric center (which may also be referred to as the centroid of volume or volumetric centroid).

The volumetric center, in the transverse direction, preferably has a transverse traction force plane distance with respect to the traction force plane, the traction force plane distance being less than 20%, preferably less than 15%, more preferably less than 10%, in particular 5% to 10%, of the track width. In addition or as an alternative, the volumetric center, in the transverse direction, preferably has a transverse bearing center plane distance with respect to the bearing center plane, the bearing center plane distance being less than 20%, preferably less than 15%, more preferably less than 10%, in particular 3% to 8%, of the bearing center width. In any case, with such a configuration, an advantageously close spatial relation between the rotational buffer device and the areas where the traction forces are introduced into the running gear and into the running gear frame is achieved.

Basically, the running gear may have any desired configuration. In particular, it may have any desired number of wheel units (e.g. wheel sets, wheel pairs or single wheel units) and, generally, any desired shape of running gear frame. With certain preferred embodiments of the invention, the running gear comprises a frame body having a first longitudinal beam, a second longitudinal beam and a transverse beam unit providing a structural connection between the longitudinal beams in the transverse direction, such that a substantially H-shaped configuration is formed. Preferably, the first rotational buffer device is spatially associated to the first longitudinal beam.

With preferred embodiments of the invention, the first rotational buffer device is spatially associated to an end section of the first longitudinal beam, since such an end section provides a favorable location for arranging the rotational buffer device in close proximity to the traction force introduction areas as outlined above. Preferably, the first rotational buffer device is connected to a first rotational buffer interface section of the first longitudinal beam, the first rotational buffer interface section, in the longitudinal direction, facing towards a center of the running gear, thereby achieving a very simple and robust configuration.

With further embodiments of the invention, the second rotational buffer device is spatially associated to one of the first longitudinal beam and the second longitudinal beam. Arrangement of the second rotational buffer device may be done in the same way as with the first rotational buffer device. Hence, preferably, the second rotational buffer device is also spatially associated to an end section of one of the first longitudinal beam and the second longitudinal beam. Furthermore, the second rotational buffer device may be connected to a second rotational buffer interface section of one of the first longitudinal beam and the second longitudinal beam, the second rotational buffer interface section, in the longitudinal direction, facing towards a center of the running gear.

It will be appreciated that, with certain embodiments of the invention, it may be sufficient to have only two rotational buffer devices (e.g. located on the same lateral side of the rail vehicle unit or on different lateral sides of the rail vehicle unit). In these cases, typically, further traction link elements may be provided for achieving proper transmission of traction forces.

Preferably, however, a third rotational buffer device and a fourth rotational buffer device are provided, the third rotational buffer device and the fourth rotational buffer device being configured to form a further traction link between the running gear and the wagon body unit. In this case, the further traction link formed by the third and fourth rotational buffer device is configured to transmit at least a major fraction of a total traction force to be transmitted along the longitudinal direction between the running gear and the wagon body unit. Hence, for example, a simple configuration may be achieved where the first and second rotational buffer device provide traction force transmission in a first direction (e.g. a direction of forward travel), while being inactive in providing traction force transmission in an opposite second direction (e.g. a direction of rearward travel). Whereas the third and fourth rotational buffer devices provide traction force transmission in this second direction (e.g. a direction of rearward travel), while being inactive in providing traction force transmission in the opposite first direction (e.g. a direction of forward travel).

With preferred embodiments of the rail vehicle unit according to the invention, the first rotational buffer device and the second rotational buffer device are spaced in the longitudinal direction. In addition or as an alternative the first rotational buffer device and the second rotational buffer device may also be spaced in the transverse direction.

With certain embodiments of the invention, at least one of the first rotational buffer device and the second rotational buffer device is adapted to restrict motion between the contact partners in the longitudinal direction while allowing motion between the contact partners in the transverse direction. As a consequence, this rotational buffer device may be of comparatively simple design concentrating on the function of restriction of motion in the longitudinal direction.

Furthermore, with certain embodiments of the invention, at least one transverse buffer device is provided, the transverse buffer device restricting motion between the contact partners in the transverse direction. This restriction of lateral motion may be realized that any desired location within the running gear. Preferably, the at least one transverse buffer device is associated to a transverse beam unit of the running gear, thereby realizing a very compact design.

The rotational buffer device may be of any desired design suitable for achieving the functions as outlined herein. Certain preferred embodiments of the rail vehicle unit according to the invention have a configuration, wherein at least one of the first rotational buffer devices comprises a buffer unit with a first support component, a second support component and at least one buffer component. The at least one buffer component, in a support direction parallel to the longitudinal direction, is arranged between the first support component and the second support component. The at least one buffer component is adapted to damp a motion between the first support component and the second support component in the support direction.

To achieve this damping function any material having suitable damping properties may be used. Preferably, the at least one buffer component comprises at least one plastic material, preferably at least one elastomeric material, since these materials have turned out to be particularly suitable for achieving robust, inexpensive and long-term stable configurations. Preferably, at least one of a polyurethane (PUR) material and a rubber material is used for the at least one buffer component.

It will be appreciated that any desired buffer characteristic may be selected for the at least one buffer component. Preferably initially steep but subsequently degressive buffer characteristic is selected. Such a configuration provides the advantage of a quick onset of a considerable buffer force and a later moderate rise in the force during larger deflections (i.e., for example, a comparatively low overall resistance when negotiating a curved track).

It will be appreciated that, one or more of these buffer components may be used. Moreover, a combination of buffer components made of different materials and/or having different sizes may be used. By this means it is in particular possible to fine-tune the mechanical properties of the rotational buffer to the requirements of the respective rail vehicle unit.

In certain embodiments, which are particularly well-suited for integration of the traction link functionality within the rotational buffer device, at least one of the first support component, the second support component and, in particular, the at least one buffer component comprises a substantially disc-shaped element or a substantially ring-shaped element defining a radial direction, the radial direction running transverse to the support direction, thereby yielding a very simple and robust configuration.

Each of the disc-shaped elements preferably has a dimension in the radial direction that is larger than its dimension in the support direction, in particular, at least 150% to 200% of its dimension in the support direction.

Furthermore, preferably, the buffer unit has a maximum buffer length in the support direction and a maximum buffer diameter in a radial direction running transverse to the support direction, the maximum buffer diameter being 160% to 280%, preferably 180% to 260%, more preferably 200% to 240%, of the maximum buffer length. In addition, the at least one buffer component may have a maximum buffer component length in the support direction and a maximum buffer component diameter in the radial direction, the maximum buffer component diameter, in particular, being 260% to 380%, preferably 280% to 360%, more preferably 300% to 340%, of the maximum buffer component length.

In all of these cases, due to the comparatively large size of the components in the radial direction, the traction force is spread over a comparatively large component leading to a reduction of the stresses within the buffer component(s). Hence, a particularly robust proper support of the considerable traction forces may be achieved. Nevertheless, due to the comparatively short dimension in the longitudinal direction, the overall volume required for the rotational buffer device is kept within acceptable limits.

With further preferred embodiments of the invention, the buffer unit comprises a guide device, the guide device restricting motion between the first support component and the second support component in a radial direction running transverse to the support direction. By this means, radial shear stresses within the buffer component may be limited and, hence, kept within acceptable limits.

Basically, any desired configuration may be chosen which is suitable to provide this guiding function. Preferably, the guide device comprises a piston element connected to the first support component and a cylinder element connected to the second support component, the piston element being adapted to plunge into the cylinder element in the support direction and to cooperate with the cylinder element in the radial direction for restricting relative motion in the radial direction. The piston element may be in permanent contact with the cylinder element. Preferably, however, the piston element, in an unloaded state of the buffer unit, has a radial play in the radial direction with respect to the cylinder element, such that a relative tilting motion is possible between the piston element and the cylinder element. Such tilting motion, in particular, may be required or helpful, respectively, when an angular deflection occurs between the two contact partners, e.g. when the rotational buffer device executes its generic function as a rotational buffer.

Generally, the piston element and the cylinder element may be placed at any desired location. Hence, for example, they may be located external to the buffer component(s). Preferably, however, the piston and cylinder arrangement is at least partially integrated within the at least one buffer component to provide a compact arrangement. Hence, preferably, at least one of the piston element and the cylinder element protrudes into a, preferably centrally located, recess of the at least one buffer component. With further advantageous embodiments of the invention, at least one of the piston element and the cylinder element comprises at least one centering section protruding into a, preferably centrally located, recess of the at least one buffer component. Thereby, in a simple and space-saving manner, mutual alignment of the respective components is achieved and maintained.

Limitation of the deflection of the at least one buffer component in the support direction may be achieved by the at least one buffer component itself, for example, simply by exhausting its deformation potential. Preferably, however, a separate hard stop arrangement is provided to fulfill this function in order to avoid excessive stressing of the at least one buffer component. Hence, according to certain embodiments of the invention, the buffer unit comprises a hard stop arrangement, the hard stop arrangement restricting motion between the first support component and the second support component in the support direction.

Here again, the hard stop arrangement may be placed at any desired location. However, preferably, here as well the hard stop arrangement is integrated within a component of the buffer unit, in particular, the at least one buffer component to provide a compact arrangement. A particularly space-saving arrangement is achieved when the hard stop arrangement is integrated into a guide device of the buffer unit, for example, a guide device as described above.

With particularly preferred embodiments of the present invention, two of the rotational buffer devices are arranged to be spaced and substantially in line with each other in the longitudinal direction, such a configuration allowing transmission of traction forces in both directions along the longitudinal direction. A particularly beneficial transmission of the forces between the running gear and the wagon body unit is achieved with embodiments, where two of the rotational buffer devices are arranged to be substantially in line with at least one secondary suspension element of the secondary suspension device in the longitudinal direction.

Preferably, the at least one secondary suspension element is located between the two rotational buffer devices.

As outlined above, the rotational buffer devices are preferably located in close proximity to the traction force introduction areas. Since traction force typically flow through the longitudinal beams of the frame body of the running gear, preferably, two of the rotational buffer devices are substantially located in a common plane with a central longitudinal axis defined by a longitudinally central section of one of the longitudinal beams, the common plane, in particular, being perpendicular to the transverse direction.

The present invention may be used for any type of rail vehicle unit. Preferably, it is used in vehicles having a low maximum angular deflection between the wagon body unit and the running gear about the rotational axis. This is basically due to the fact that in such cases, for example, only a comparatively small substantially unimpeded deflection necessary prior to a with noticeable onset of the damping function on the rotational buffer device. Consequently, in operating states where the rotational buffer device fulfills his function as a traction link, only a comparatively small, hardly noticeable delay is caused prior to the onset of the traction link function.

Hence, with certain embodiments of the invention, the wagon body unit is a wagon body or a bolster connected to a wagon body. The wagon body, in the longitudinal direction, has a wagon body length which is selected such that, during normal operation of the rail vehicle unit on a given track network having a given minimum radius of track curvature, a maximum angular deflection of the wagon body with respect to the running gear about the rotational axis from a neutral, undeflected state is at most 4°, preferably at most 3°, more preferably at most 2.5°. In addition or as an alternative, the wagon body, in the longitudinal direction, has a wagon body length which is 300% to 1000%, preferably 400% to 900%, more preferably 500% to 700%, of a wheel unit distance of two wheel units of the running gear in the longitudinal direction. In both cases advantageously small angular deflections about the rotational axis as outlined above occur during normal operation of the vehicle.

The present invention further relates to a corresponding running gear for rail vehicle having the features of the running gear as outlined herein.

Further embodiments of the present invention will become apparent from the dependent claims and the following description of preferred embodiments which refers to the appended figures.

DETAILED DESCRIPTION OF THE INVENTION

Figure 1:
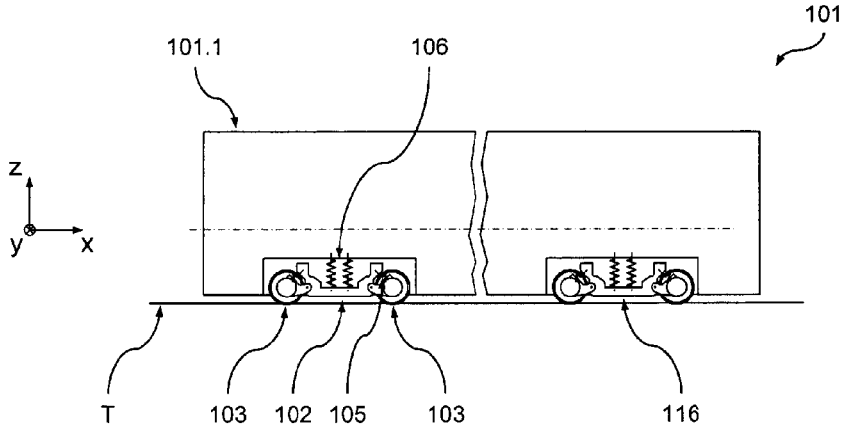
FIG. 1 is a schematic side view of a part of a preferred embodiment of a rail vehicle according to the present invention with a preferred embodiment of a running gear unit according to the present invention.

With reference to FIGS. 1 to 8 a preferred embodiment of a rail vehicle unit 101 according to the present invention comprising a preferred embodiment of a running gear 102 according to the invention will now be described in greater detail. In order to simplify the explanations given below, an xyz-coordinate system has been introduced into the Figures, wherein (on a straight, level track T) the x-axis designates the longitudinal direction of the rail vehicle 101, the y-axis designates the transverse direction of the rail vehicle 101 and the z-axis designates the height direction of the rail vehicle 101 (the same, of course, applies for the running gear 102). It will be appreciated that all statements made in the following with respect to the position and orientation of components of the rail vehicle, unless otherwise stated, refer to a static situation with the rail vehicle 101 standing on a straight level track under nominal loading.

The vehicle 101 is a low floor rail vehicle such as a tramway or the like. The vehicle 101 comprises a wagon body 101.1 supported by a suspension system on the running gear 102. The running gear 102 comprises two wheel units in the form of wheel sets 103 supporting a running gear frame 104 via a primary spring unit 105. The running gear frame 104 supports the wagon body via a secondary spring unit 106.

The running gear frame 104 has a frame body 107 comprising two longitudinal beams 108 and a transverse beam unit 109 providing a structural connection between the longitudinal beams 108 in the transverse direction, such that a substantially H-shaped configuration is formed. Each longitudinal beam 108 has two free end sections 108.1 and a central section 108.2. The central section 108.2 is connected to the transverse beam unit 109 while the free end sections 108.1 form a primary suspension interface 110 for a primary suspension device 105.1 of the primary suspension unit 105 connected to the associated wheel unit 103. In the present example, a compact and robust rubber-metal-spring is used for the primary spring device 105.1.

Each longitudinal beam 108 has an angled section 108.3 associated to one of the free end sections 108.1. Each angled section 108.3 is arranged such that the free end section 108.1 forms a pillar section mainly extending in the height direction. Hence, basically, the frame body 107 has a comparatively complex, generally three-dimensional geometry.

Each longitudinal beam 108 has a pivot interface section 111 associated to the free end section 108.1. The pivot interface section 111 forms a pivot interface for a pivot arm 112 rigidly connected to a wheel set bearing unit 103.1 of the associated wheel unit 103. The pivot arm 112 is pivotably connected to the frame body 107 via a pivot bolt connection 113. The pivot bolt connection 113 comprises a pivot bolt 113.1 defining a pivot axis 113.2. The bolt 113.1 is inserted into matching recesses in a forked end of the pivot arm 112 and a pivot interface recess 111.1 in a lug 111.2 of the pivot interface section 111 (the lug 111.2 being received between the end parts of the pivot arm 112).

To reduce the complexity of the frame body 107, the respective pivot interface section 111 is integrated into to the angled section 108.3 of the longitudinal beams 108, such that, nevertheless, a very compact arrangement is achieved. More precisely, integration of the pivot interface section 111 into the angled section 108.3 leads to a comparatively smooth, unbranched geometry of the frame body.

This compact, smooth and unbranched arrangement, among others, makes it possible to form the frame body 107 as a monolithically cast component. More precisely, the frame body 107 is formed as a single piece cast in an automated casting process from a grey cast iron material. The grey cast iron material has the advantage that it comprises a particularly good flow capability during casting due to its high carbon content and thus leads to a very high level of process reliability.

Casting is done in conventional molding boxes of an automated casting production line. Consequently, production of the frame body 107 is significantly simplified and rendered more cost effective than in conventional solutions with welded frame bodies. In fact, it has turned out that (compared to a conventional welded frame body) a cost reduction by more than 50% may be achieved with such an automated casting process.

The grey cast iron material used in the present example is a so called nodular graphite iron cast material or spheroidal graphite iron (SGI) cast material as currently specified in European Norm EN 1563. More precisely, a material such as EN-GJS-400-18U LT is used, which provides a good compromise between strength, elongation at fracture and toughness, in particular at low temperatures. Obviously, depending on the mechanic requirements on the frame body, any other suitable cast material as outlined above may be used.

To achieve proper integration of the pivot interface section 111 into the angled section 108.3, the respective pivot interface section 111, in the longitudinal direction (x-axis), is arranged to be retracted behind the associated free end section 108.1.

Furthermore (as can be seen, in particular, from FIG. 5), a considerable reduction in the building space (required for frame body 107 within the running gear 102) is accomplished in that the primary suspension interface 110 is configured such that the total resultant support force $F_{TRS}$ acting in the area of the respective free end 108.1 (i.e. the total force resulting from all the support forces acting via the primary suspension 105 in the region the free end 108.1, when the running gear frame 104 is supported on the wheel unit 103) is substantially parallel with respect to the xz-plane, while being inclined with respect to the longitudinal direction (x-axis) by a primary suspension angle $\alpha_{PSF,x}$ and inclined with respect to the height direction (z-axis) by a complementary primary suspension angle $$\alpha_{PSF,z}=90°-\alpha_{PSF,x}. \quad (1)$$

Such an inclination of the total resultant support force $F_{TRS}$, compared to a configuration as known from DE 41 36 926 A1, allows the primary suspension device 105.1 to move closer to the wheel set 103, more precisely closer to the axis of rotation 103.2 of the wheel set 103. This has not only the advantage that the primary suspension interface 110 also can be arranged more closely to the wheel unit, which clearly saves space in the central part of the running gear 102. Furthermore, the pivot arm 112 connected to the wheel set bearing unit 103.1 can be of smaller, more lightweight and less complex design.

Furthermore, such an inclined total resultant support force $F_{TRS}$ yields the possibility to realize a connection between the pivot arm 112 and the frame body 107 at the pivot interface 111 which is both self adjusting under load (due to the components of the total resultant force $F_{TRS}$ acting in the longitudinal direction and the height direction) while being easily dismounted in absence of the support load $F_{TRS}$ as it is described in greater detail in pending German patent application No. 10 2011 110 090.7 (the entire disclosure of which is incorporated herein by reference).

Finally, such a design has the advantage that, not least due to the fact that the primary suspension interface section 110 moves closer to the wheel set 103, it further facilitates automated production of the frame body 107 using an automated casting process.

Although, basically, the total resultant support force $F_{TRS}$ may have any desired and suitable inclination with respect to the longitudinal direction and the height direction, in the present example, the total resultant support force $F_{TRS}$ is inclined with respect to the longitudinal direction by a primary suspension angle $\alpha_{PSF,x}=45°$. Consequently, the total resultant support force is inclined with respect to the height direction by a complementary primary suspension angle $\alpha_{PSF,z}=90°-\alpha_{PSF,x}=45°$. Such an inclination provides a particularly compact and, hence, favorable design. Furthermore, it also provides an advantageous introduction of the support loads $F_{TRS}$ from the wheel set 103 into the frame body 107. Finally, as a consequence, the pillar section or end section 108.1 may be formed in a slightly forward leaning configuration which is favorable in terms of facilitating cast material flow and, hence, use of an automated casting process.

Figure 5:
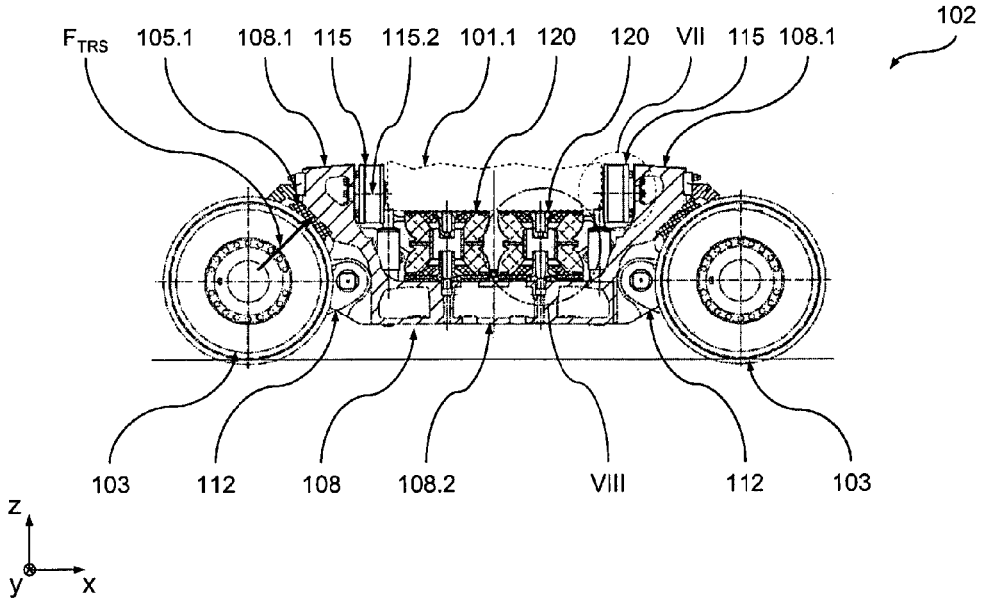
FIG. 5 is a schematic sectional view of a part of the running gear unit along line V-V of FIG. 1.

As may be further seen from FIG. 5, the primary suspension interface 110 and the primary suspension device 105.1 are arranged such that the total resultant support force $F_{TRS}$ intersects a wheel set shaft 103.3 of the wheel set 103, leading to a favorable introduction of the support loads from the wheel set 103 into the primary suspension device 105.1 and onwards into the frame body 107. More precisely, the total resultant support force $F_{TRS}$ intersects the axis of wheel rotation 103.2 of the wheel shaft 103.3.

Such a configuration, among others, leads to a comparatively short lever arm of the total resultant support force $F_{TRS}$ (for example, a lever arm $A_{TRS}$ at the location of the pivot bolt 113.1) and, hence, comparatively low bending moments acting in the longitudinal beam 108, which, in turn, allows a more lightweight design of the frame body 107.

A further advantage of the configuration as outlined above is the fact that the pivot arm 112 may have a very simple and compact design. More precisely, in the present example, the pivot arm 112 integrating the wheel set bearing unit 103.1, apart from the forked end section (receiving the pivot bolt 113.1) simply has to provide a corresponding support surface for the primary spring device 105.1 located close to the outer circumference of the wheel set bearing unit 103.1. Hence, compared to known configurations, no complex arms or the like are necessary for introducing the support forces into the primary spring device 105.1.

The transverse beam unit 109 comprises two transverse beams 109.1, which are arranged to be substantially symmetric to each other with respect to a plane of symmetry parallel to the yz-plane and arranged centrally within the frame body 107. The transverse beams 109.1 (in the longitudinal direction) are separated by a gap 109.5.

Figure 3:
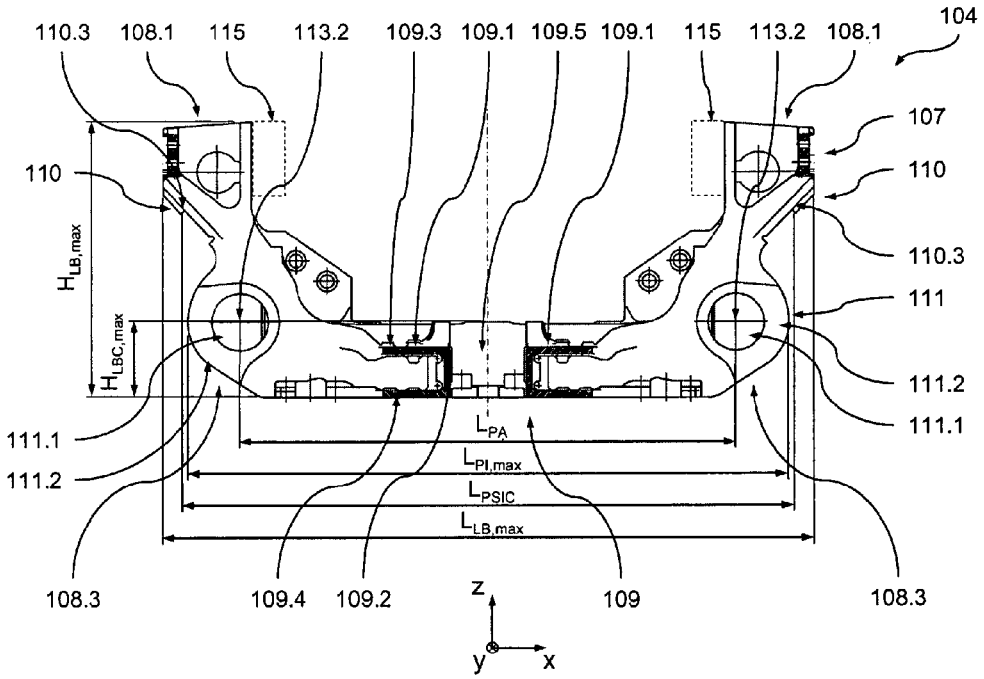
FIG. 3 is a schematic sectional view of the frame body of FIG. 2 along line of FIG. 1.
Figure 4:
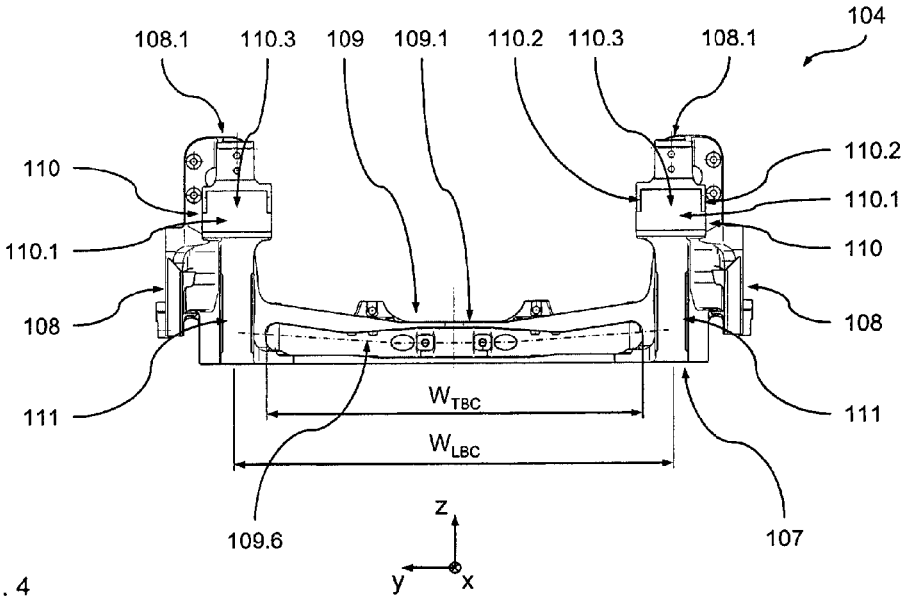
FIG. 4 is a schematic frontal view of the frame body of FIG. 2.

As can be seen from FIG. 3, each transverse beam 109.1, in a sectional plane parallel to the xz-plane, has a substantially C-shaped cross section with an inner wall 109.2, an upper wall 109.3, and a lower wall 109.4. The C-shaped cross section is arranged such that, in the longitudinal direction, it is open towards the (more closely located) free end of the frame body 107, while it is substantially closed by the inner wall 109.2 located adjacent to the center of the frame body 107. In other words, the open sides of the transverse beams 109.1 are facing away from each other.

Such an open design of the transverse beam 109.1 has the advantage that (despite the general rigidity of the materials used) not only the individual transverse beam 109.1 is comparatively torsionally soft, i.e. shows a comparatively low resistance against torsional moments about the transverse y-axis (compared to a closed, generally box shaped design of the transverse beam). The same applies to the transverse beam unit 109 as a whole, since the inner walls 109.2 (in the longitudinal direction) are located comparatively centrally within the transverse beam unit 109, such that their contribution to the torsional resistance moment about the transverse y-axis is comparatively low.

Furthermore, the gap 109.5, in a central area of the frame body 107, has a maximum longitudinal gap dimension $L_{G,max}$, which is about 100% of a minimum longitudinal dimension $L_{TB,min}$ of one of the transverse beams 109.1 in the longitudinal direction (in the central area of the frame body 107). The gap 109.5 has the advantage that the bending resistance in the plane of main extension of the two transverse beams 109.1 (parallel to the xy-plane) is increased without adding to the mass of the frame body 107, such that a comparatively lightweight configuration is achieved.

Figure 6:
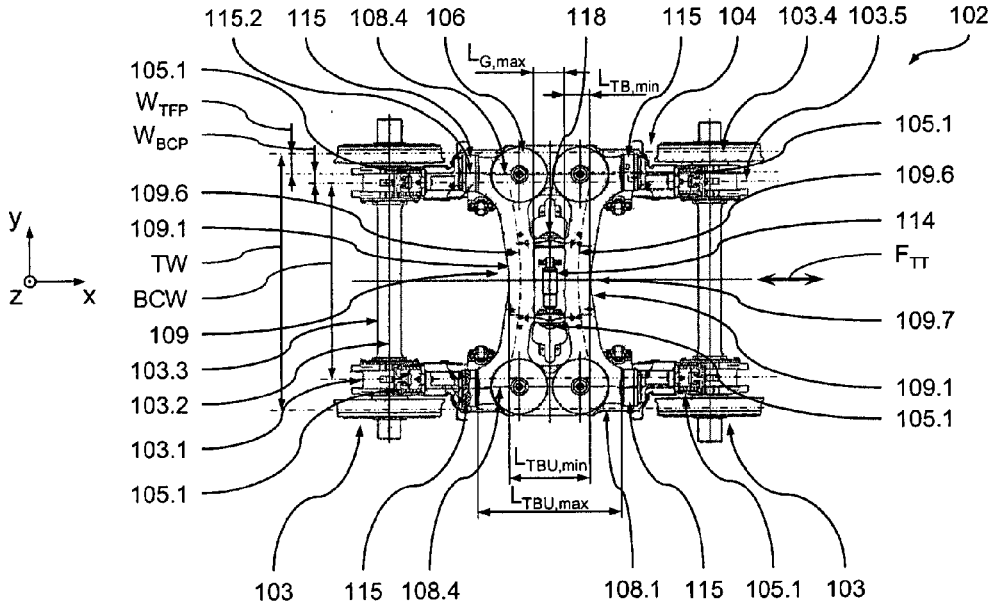
FIG. 6 is a schematic top view of the running gear unit of FIG. 1.

Furthermore, the gap 109.5 is readily available for receiving other components of the running gear 102 (such as a transverse damper 114 as shown in FIG. 6), which is particularly beneficial in modern rail vehicles with their severe constraints regarding the building space available.

The C-shaped cross section extends over a transversally central section of the transverse beam unit 109, since, at this location, a particularly beneficial influence on the torsional rigidity of the transverse beam unit is achieved. In the present embodiment, the substantially C-shaped cross section extends over the entire extension of the transverse beam unit in the transverse direction (i.e. from one longitudinal beam 108 to the other longitudinal beam 108). Hence, in the present example, the C-shaped cross section extends over a transverse dimension $W_{TBC}$, which is 85% of a transverse distance $W_{LBC}$ between longitudinal center lines 108.4 of the longitudinal beams 108 in the area of the transverse beam unit 109. By this means a particularly advantageous torsional rigidity may be achieved even with such a grey cast iron frame body 107.

As far as the extension in the transverse direction is concerned, the same (as for the C-shaped cross-section) also applies to the extension of the gap 109.5. Furthermore, it should be noted that the longitudinal gap dimension doesn't necessarily have to be the same along the transverse direction. Any desired gap width may be chosen as needed.

In the present example, each transverse beam 109.1 defines a transverse beam center line 109.6, which has a generally curved or polygonal shape in a first plane parallel to the xy-plane and in a second plane parallel to the yz-plane. Such generally curved or polygonal shapes of the transverse beam center lines 109.6 have the advantage that the shape of the respective transverse beam 109.1 is adapted to the distribution of the loads acting on the respective transverse beam 109.1 resulting in a comparatively smooth distribution of the stresses within the respective transverse beam 109.1 and, ultimately, in a comparatively lightweight and stress optimized frame body 107.

Figure 2:
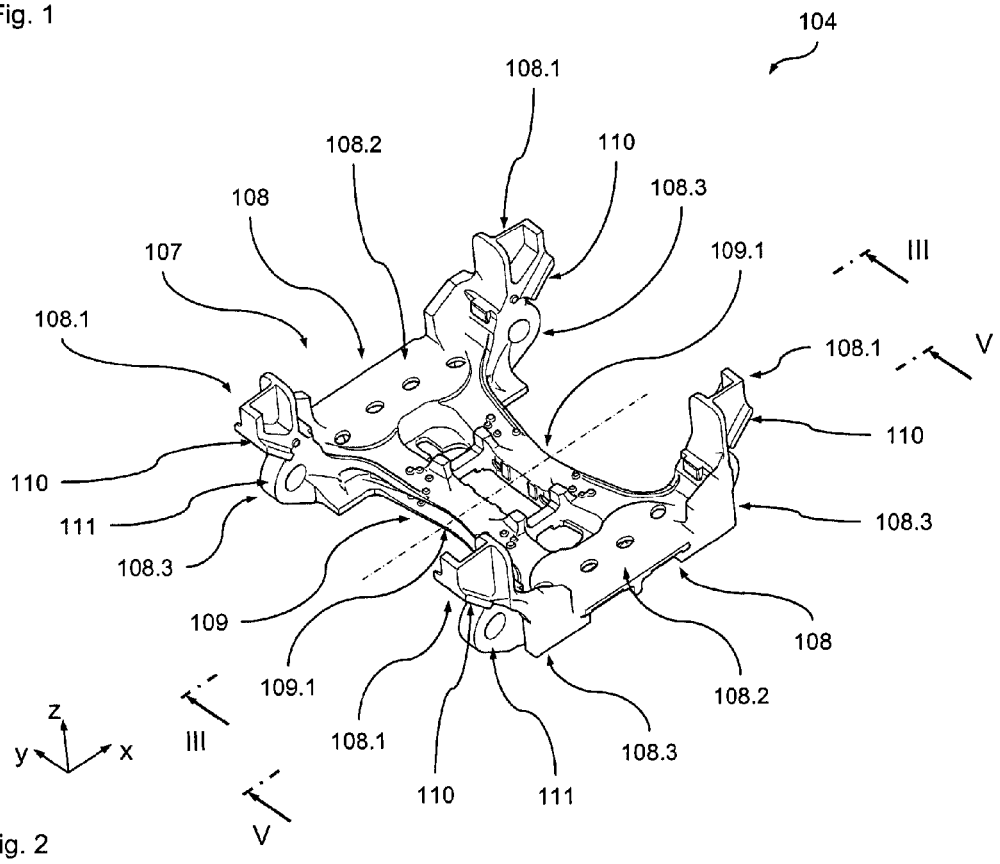
FIG. 2 is a schematic perspective view of a frame body of the running gear unit of FIG. 1.

As a consequence, as can be seen from FIGS. 2 and 6, the transverse beam unit 109 is a centrally waisted unit with a waisted central section 109.7 defining a minimum longitudinal dimension of the transverse beam unit $L_{TBU,min}$ (in the longitudinal direction) which, in the present example, is 65% of a maximum longitudinal dimension of the transverse beam unit $L_{TBU,max}$ (in the longitudinal direction). This maximum longitudinal dimension, in the present example, is defined at the junction of the transverse beam unit 109 and the longitudinal beams 108.

Generally, the extent of the waist of the transverse beam unit 109 may be chosen as a function of the mechanical properties of the frame body 107 (in particular, the torsional rigidity of the frame body 107) to be achieved. In any case, with the transverse beam unit design as outlined herein, a well-balanced configuration is achieved showing both, comparatively low torsional rigidity (about the transverse direction) and comparatively high bending rigidity (about the height direction). This configuration is particularly advantageous with respect to the derailment safety of the running gear 102 since the running gear frame 104 is able to provide some torsional deformation tending to equalize the wheel to rail contact forces on all four wheels of the wheel sets 103.

As can be further seen from FIGS. 3 and 6, in the present example, each free end section 108.1, in a section facing away from the primary spring interface 110 (hence, facing towards the longitudinal center of the running gear 102), forms a buffer interface for a rotational buffer device 115. The four rotational buffer devices 115 integrate the functionality of a rotational buffer device and a longitudinal buffer device for the wagon body 101.1. Furthermore, according to the present invention, the four rotational buffer devices 115 also are adapted to pairwise form a traction link between the frame body 107 and the wagon body 101.1 supported on the frame body 107 via the secondary suspension device 106. It will be appreciated that such a configuration is particularly beneficial since it provides a high degree of functional integration leading to a comparatively lightweight overall design as will be explained in more detail in the following.

The rotational buffer devices 115 integrate the ability to form a traction link between the running gear 102 and the wagon body 101.1 without having any noticeable loss in riding comfort due to a late onset of the traction force transmission. More precisely, the two rotational buffer devices 115 located, in the longitudinal direction, on the same side of the running gear center (but on different lateral sides of the running gear 102) form a first rotational buffer device 115 and a second rotational buffer device 115 which are not only adapted to damp a rotational motion between the running gear 102 and the wagon body 101.1 about a rotational axis parallel to the height direction. The first rotational buffer device 115 and the second rotational buffer device 115 are configured to form a traction link between the running gear 102 and the wagon body 101.1 configured to transmit at least a major fraction of a total traction force $F_{TT}$ to be transmitted along the longitudinal direction between the running gear 102 and the wagon body 101.1.

In the present example, apart from the traction links formed by the rotational buffer devices 115, no further traction link element is provided between the running gear 102 and the wagon body 101.1. Consequently, the traction link formed by the first and second rotational buffer devices 115 (mounted to the frame body 107 and the first contact partner in the sense of the present invention) transmits, in a first direction (e.g. a direction of forward travel), the remaining fraction of the total traction force $F_{TT}$ to be transmitted to the wagon body 101.1 (at the second contact partner in the sense of the present invention), which is not already taken or transmitted, respectively, by the secondary suspension device 106.

Figure 7:
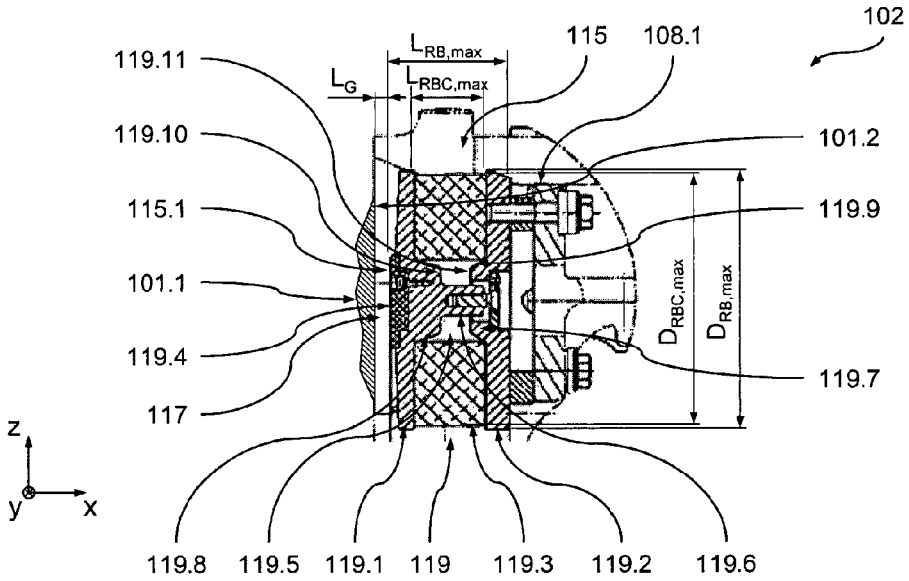
FIG. 7 is a schematic sectional view of detail VII of FIG. 5.

As can be seen best from FIG. 7, traction force transmission between the running gear 102 and the wagon body 101 is provided via a first contact surface 115.1 of the rotational buffer device 115 contacting a second contact surface 101.2 formed at the wagon body 101.1. All four rotational buffer devices 115 are arranged such that the first contact surface 115.1 and the second contact surface 101.2, in a neutral state of the rail vehicle unit 101 (i.e. with the rail vehicle standing on a straight, level track), are separated by a longitudinal gap 117 having a comparatively small longitudinal gap dimension $L_G$=1 mm in the longitudinal direction.

In this neutral state, the two contact surfaces 115.1 and 101.2 are in very close proximity (in the longitudinal direction) but do not contact each other. Moreover, the two contact surfaces 115.1 and 101.2 are arranged such that the width of the gap 117 remains unchanged if there is relative motion between the running gear 102 and the wagon body 101.1 exclusively in the height direction and/or exclusively in the transverse direction. Hence, wear of the contact surfaces is considerably reduced, since no friction loaded motion occurs if there is such relative exclusively in the height direction and/or exclusively in the transverse direction.

Furthermore, the rotational buffer devices 115 initially do not counteract angular deflection of the wagon body 101.1 with respect to the running gear (about a rotational axis parallel to the height direction). At a certain deflection between the running gear 102 and the wagon body 101.1 in the longitudinal direction, however, the two contact surfaces 115.1 and 101.2 contact each other, thereby starting traction force transmission in the longitudinal direction via the contact surfaces 115.1 and 101.2 (i.e. via the respective rotational buffer device 115).

The small width of gap 117 in the neutral position has the advantage that a delay of the onset of traction force transmission which would be noticeable and felt to be annoying by the passengers of the vehicle 101 (e.g. as a noticeably abrupt longitudinal acceleration) is avoided. Still, with the present example, the width of gap 117 is sufficiently large to provide acceptable angular deflection between the running gear 102 and the wagon body 101.1.

Arrangement of the rotational buffer devices 115 at the free end sections 108.1 has the inventors that traction force transmission through the rotational buffer devices 115 occurs in spatially close arrangement to the traction force introduction areas where the traction forces are introduced into the running gear 102 and into the frame body 107.

More precisely, the wheel sets 103 define a track width TW in the transverse direction and a traction force plane 103.4. The traction force plane 103.4, in the neutral state of the rail vehicle unit, extends through the respective wheel to rail contact point of one of the wheels of the wheel sets 103 and is perpendicular to the transverse direction. The wheel sets 103 further define a bearing center width BOW between centers of the wheel bearings 103.1 in the transverse direction and a bearing center plane 103.5. The bearing center plane 103.5, in the neutral state of the rail vehicle 101, extends through the center of the wheel bearings 103.1 and is perpendicular to the transverse direction. Furthermore, each rotational buffer device 115 has a volumetric center 115.2 (which may also be referred to as the centroid of volume or volumetric centroid).

The volumetric center 115.2 of each of the rotational buffer devices 115, in the transverse direction, has a transverse traction force plane distance $W_{TFP}$ with respect to the associated traction force plane 103.4 which is about 8% of the track width TW. In addition, the volumetric center 115.2 of each of the rotational buffer devices 115, in the transverse direction, has a transverse bearing center plane distance $W_{BCP}$ with respect to the bearing center plane 103.5 which is 6% of the bearing center width BCW. Consequently, an advantageously close spatial relation between the rotational buffer devices 115 and the areas where the traction forces are introduced into the running gear 102 (namely the traction force plane 103.4) and into the frame body 107 (namely the bearing center plane 103.5) is achieved. Finally, the volumetric center 115.2 of the rotational buffer devices 115 is located in a common plane (perpendicular to the transverse direction) with the longitudinal central axis 108.4 of the central section 108.2 of the associated longitudinal 108.

The above configuration has the advantage that, in the present example, it is possible to realize virtually the shortest possible way for the traction forces to be transmitted from the running gear 102, more precisely, ultimately from the point of wheel to rail contact, to the wagon body 101.1. Consequently, in the present example unlike in many solutions known in the art, the traction forces to be transmitted do not have to take their way through the transverse beam unit 109. This makes it possible to realize the lightweight and less rigid design of the transverse beam unit 109 as it has been outlined in detail above. As mentioned, such a less rigid design, in particular, a reduced torsional rigidity about the transverse direction, is beneficial in terms of riding comfort and derailment safety. Hence, ultimately, such the running gear 102 of the present example, at least from the point of view of riding comfort and derailment safety, is much more forgiving to unfavorable track conditions.

It will be appreciated that, when a traction force is to be transmitted in the opposite second direction (e.g. a direction of rearward travel) the two rotational buffer devices 115 (in the longitudinal direction) located on the other side of the running gear center (and forming a third and fourth rotational buffer device in the sense of the present invention) take over the function of the traction link in the same manner as it has been described above for the first and second rotational buffer device. In other words, in such a case, the third and fourth rotational buffer devices 115 form a further traction link between the running gear 102 and the wagon body 101.1 in the sense of the present invention.

Transverse motion of the wagon body 101.1 with respect to the running gear 102, in a conventional manner, is provided by two transverse buffer devices 118 mounted to the transverse beam unit 109 in proximity to the transverse damper 114.

As can be seen best from FIG. 7, the respective rotational buffer device 115 comprises a buffer unit 119 with a substantially disk shaped first support component 119.1, a substantially disk shaped second support component 119.2 and a substantially ring-shaped buffer component 119.3. The buffer component 119.3, in a support direction parallel to the longitudinal direction, is arranged between the first support component 119.1 and the second support component 119.2.

The buffer component 119.3 is adapted to damp a motion between the first support component 119.1 and the second support component 119.2 in the support direction. To achieve this damping function, in the present example, the buffer component 119.3 is made from a polyurethane (PUR) material, since these materials have turned out to be particularly suitable for achieving robust, inexpensive and long-term stable components.

It will be appreciated that any desired buffer characteristic may be selected for the buffer component 119.3. Preferably, an initially steep but subsequently degressive buffer characteristic is selected. Such a configuration provides the advantage of a quick onset of a considerable buffer force and, hence, the traction link effect and a later moderate rise in the force during larger deflections (i.e., for example, a comparatively low overall resistance when negotiating a curved track).

The first and second support component 119.1 and 119.2 are made from a metal to provide structural rigidity and a long-term stable mounting interface, respectively. The first contact surface 115.1, however, is formed by an exchangeable contact insert 119.4 of the first support component 119.1 made from plastic material to reduce friction between the first and second contact partner.

Each of the components 119.1 to 119.3, in the present example, has a dimension in the radial direction (running transverse to the support direction) that is larger than its dimension in the support direction, in particular, at least 150% to 200% of its dimension in the support direction.

Furthermore, as can be clearly seen from FIG. 7, the buffer unit 119 has a maximum buffer length $L_{RB,max}$ in the support direction and a maximum buffer diameter $D_{RB,max}$ in the radial direction which is 225% of the maximum buffer length. In addition, the buffer component 119.3 has a maximum buffer component length $L_{RBC,max}$ in the support direction and a maximum buffer component diameter $D_{RBC,max}$ in the radial direction, which is 350% of the maximum buffer component length $L_{RBC,max}$. Consequently, due to the comparatively large size of the components in the radial direction, the traction force is spread over a comparatively large component leading to a reduction of the stresses within the buffer components 119.1 to 119.3. Nevertheless, due to the comparatively short dimension of the buffer components 119.1 to 119.3 in the longitudinal direction, the overall volume required for the rotational buffer device 115 is kept within acceptable limits.

The buffer unit 119 comprises a guide device 119.5 restricting motion between the first support component 119.1 and the second support component 119.2 in the radial direction to keep radial shear stresses within the buffer component 119.3 acceptably low. To this end, the guide device 119.5 comprises a piston element 119.6 connected to the first support component 119.1 and a cylinder element 119.7 connected to the second support component 119.2.

The piston element 119.6 and the cylinder element 119.7 are located centrally received within the buffer component 109.3, such that a very compact configuration is achieved. Furthermore, the piston element 119.6 and the cylinder element 119.7 each comprises a is centering section 119.8 and 119.9, respectively, cooperating with the inner wall of the one buffer component 119.3 to provide, in a simple and space-saving manner, mutual alignment of the components of the buffer unit 119.

In an unloaded state of the buffer unit 119 (as shown in FIG. 7), the piston element 119.6 has a radial play in the radial direction with respect to the cylinder element 119.7, such that a relative tilting motion is possible between the piston element 119.6 and the cylinder element 119.7. Such tilting motion, in particular, may be appropriate when an angular deflection occurs between the running gear 102 and the wagon body 101.1, i.e. when the rotational buffer device 115 executes its generic function as a rotational buffer.

Upon loading of the buffer unit 119 and, hence, compression of the buffer component 119.3, the piston element 119.6 plunges into the cylinder element 119.7 in the support direction. In case the buffer unit 119 is loaded such that radial deflection of the first support component 119.1 is caused (with respect to the second support component 119.1), the piston element 119.6 cooperates with the cylinder element 119.7 in the radial direction to restrict relative motion in the radial direction.

Limitation of the deflection of the buffer component 119.3 in the support direction is provided by a hard stop arrangement formed by mating contact surfaces 119.10 and 119.11 formed at the respective centering section 119.8 and 119.9 of the piston element 119.6 and the cylinder element 119.7, respectively. Hence, excessive compressive loading of the buffer component 119.3 is avoided.

It will be appreciated that, in the present example, the part of the wagon body 101.1 supported on the running gear 102 has a wagon body length which is selected such that, during normal operation of the rail vehicle 101 on a given track network having a given minimum radius of track curvature, a maximum angular deflection of the wagon body with respect to the running gear about the rotational axis from a neutral, undeflected state (as shown in the figures) is about 2.5°. To this end, the part of the wagon body 101.1 supported on the running gear 102, in the longitudinal direction, has a wagon body length which is 600%, of a wheel unit distance of the two wheel units 103 (more precisely of their respective axis of rotation) of the running gear 102 in the longitudinal direction. Hence, advantageously small angular deflections of the wagon body 101.1 with respect to the running gear 102 about the rotational axis as outlined above occur during normal operation of the vehicle 101.

Figure 8:
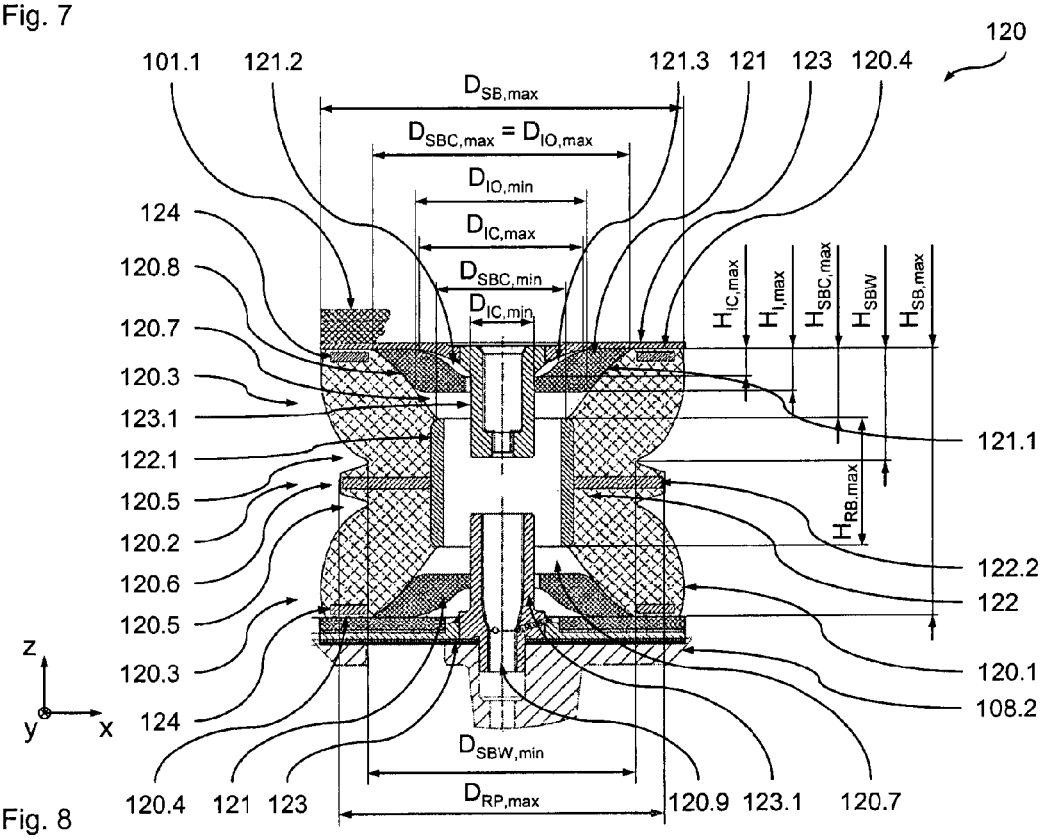
FIG. 8 is a schematic sectional view of detail VIII of FIG. 5.

As can be seen from FIGS. 5, 6 and 8, in the longitudinal direction, the rotational buffer devices 115 on each side of the vehicle are arranged to be substantially in line with each other and with two secondary suspension elements 120 of the secondary suspension device 106 located between them. Thereby, a particularly beneficial transmission of the forces between the running gear 102 and the wagon body 101.1.

As can be seen best from FIG. 7, according to an aspect of the present invention, each secondary suspension element is formed by a spring device 120 comprising a spring body 120.1 substantially made of a polymeric material, namely rubber, and defining an axial direction (in a neutral state as shown being parallel to the height direction) and a radial direction.

The spring body 120.1, in the axial direction, has a central section 120.2 located between a first end section 120.3 terminating in a first outer end surface 120.4 and a second end section 120.3 terminating in a second outer end surface 120.4. The central section 120.2 has two radially waisted sections 120.5 separated by a centrally located (in the axial direction) protrusion 120.6 of the spring body 120.1.

Each of the and sections has a recess extending, in the axial direction, from the outer end surface 120.4 towards the central section 120.2 such that an axial spring body cavity 120.7 is formed. The axial spring body cavity 120.7 is confined by a compliant inner surface 120.8 of the spring body 120.1.

An insert 121 made from a polymeric material, namely from a polyamide (PA) material, is inserted into the axial spring body cavity 120.7. The insert 121 contacts the compliant inner surface 120.8 of the spring body 120.1 to modify a rigidity of the spring device compared to a reference state, where the insert 121 is not inserted into the axial spring body cavity 120.7.

More precisely, the insert modifies both, the axial rigidity (in the axial direction) and the transverse rigidity (transverse to the actual direction) of the spring device 120.

It should be noted that the insert 121 may not only be used to statically modify the respective mechanical property, e.g. by simply adding a constant offset to the respective characteristic of the spring body 120.1. Rather, the insert 121 may also be used to variably modify the characteristic of the respective rigidity. Hence, for example, depending on the design of the insert 121, the insert 121 may be used to provide not only an at least section wise constant offset in the characteristic of the respective rigidity with increasing deflection. It may also be used to provide an at least section wise progressive and/or and at least section wise degressive characteristic of the respective rigidity.

In the present example, the insert 121 is a substantially dome shaped, ring toroid component having a generally conical outer shape appropriately mating with the compliant spring body cavity wall 120.8. To this end, the insert 121 is confined by an insert outer wall surface 121.1, the insert outer wall surface, in a sectional plane comprising a central axis of the insert (as shown in FIG. 8), has a curved sectional contour.

To achieve the desired modification of the corresponding rigidity, tuning of the mechanical properties of the insert 121, in particular, its resistance to deflection, is achieved by providing an insert cavity 121.2 located at an end side of the insert 121 facing away from the central section 120.2 of the spring body 120.1. Such an insert cavity 121.2 provides an additional degree of design freedom which allows a very simple adaptation of the resistance to deflection by simply modifying the shape of the cavity 121.2.

The insert cavity 121.2 also is of a substantially toroid, generally conical outer shape, thereby allowing a very simple and easy to manufacture adaptation of the mechanical properties of the insert 121. Here is well, the insert cavity is confined by an insert cavity wall surface 121.3 which, in a sectional plane comprising a central axis of the insert cavity (as shown in FIG. 8), has a curved sectional contour.

The spring body 120.1 has a substantially toroid outer shape, more precisely, the spring body 120.1 is substantially hour-glass shaped. Hence, the spring body is confined by a spring body outer wall surface which, in a sectional plane comprising a central axis of the spring body 120.9 (as shown in FIG. 8), has a section-wise curved sectional contour and (in the region of the radial protrusion 120.6) a section-wise polygonal sectional contour.

Similar applies to the spring body cavity 120.7. In the embodiment shown, the spring body cavity 120.7 has a substantially toroid outer shape, namely a generally conical outer shape. The compliant spring body cavity wall surface 120.8, in a sectional plane comprising the central axis 120.9 (as shown in FIG. 8), has a section-wise curved sectional contour.

The dimensions of the spring body 120.1 and the spring body cavity 120.7 are adapted to the specific application of the spring device 120, in particular to the axial rigidity and the transverse rigidity of the spring device 120 to be achieved, by selecting the following dimensions.

Generally, the spring body 120.1 defines, in the first end section 120.3 and in the radial direction, a maximum outer spring body diameter $D_{SB,max}$, while each waisted section 120.5, in the radial direction, defines a minimum waist diameter $D_{SBW,min}$ of the spring body 120.1 located, in the axial direction, at a maximum axial waist distance $H_{SBW}$ from the outer end surface 120.4. In the present embodiment, the minimum waist diameter $D_{SBW,min}$ is 76% of the maximum outer spring body diameter $D_{SB,max}$. In addition, the spring body 120.1, in the axial direction, extends over a maximum axial spring dimension $H_{SB,max}$, the maximum axial waist distance $H_{SBW}$ being 41% of the maximum axial spring dimension $H_{SB,max}$.

Furthermore, generally, the spring body cavity 120.7 defines, in the radial direction, a maximum spring body cavity diameter $D_{SBC,max}$ and a minimum spring body cavity diameter $D_{SBC,min}$, and, in the axial direction, a maximum axial spring body cavity dimension $H_{SBC,max}$. In the present example, the maximum spring body cavity diameter $D_{SBC,max}$ is 70% of the maximum outer spring body diameter $D_{SB,max}$. In addition, the minimum spring body cavity diameter $D_{SBC,min}$ is 50% of the maximum spring body cavity diameter $D_{SBC,max}$. Furthermore, the maximum axial spring body cavity dimension $H_{SBC,max}$ is 63% of the maximum axial waist distance $H_{SBW}$.

The dimensions of the insert 121 and the insert cavity 121.2 are adapted to the specific modification of the respective rigidity of the spring device 120 to be achieved. In the present example, the following dimensions are chosen.

Generally, the insert 121 defines, in the radial direction, a maximum outer insert diameter $D_{IO,max}$ and a minimum outer insert diameter $D_{IO,min}$, and, in the axial direction, a maximum axial insert dimension $H_{I,max}$. In the present example, the minimum outer insert diameter $D_{IO,min}$ is 61% of the maximum outer insert diameter $D_{IO,max}$. Furthermore, the maximum axial insert dimension $H_{I,max}$ is 58% of a maximum axial spring body cavity dimension $H_{SBC,max}$ (in the axial direction).

Furthermore, generally, the insert cavity 121.2 (in the radial direction) defines a maximum insert cavity diameter $D_{IC,max}$ and a minimum insert cavity diameter $D_{IC,min}$, and, in the axial direction, a maximum axial insert cavity dimension $H_{IC,max}$. Here, the maximum insert cavity diameter $D_{IC,max}$ is 68% of the maximum outer insert diameter $D_{IO,max}$. In addition, the minimum insert cavity diameter $D_{IC,min}$ is 37% of the maximum insert cavity diameter $D_{IC,max}$. Furthermore, the maximum axial insert cavity dimension $H_{IC,max}$ is 71% of the maximum axial insert dimension $H_{I,max}$.

It should be noted that, due to their rotationally symmetric design, the spring body 120.1 and the insert 121 provide, in the radial direction and the transverse direction, respectively, a nondirectional behavior.

As can be seen best from FIG. 8, the central section 120.2 of the spring body 120.1 comprises an inner reinforcement unit 122. The inner reinforcement unit 122 comprises a hollow cylindrical reinforcement bush 122.1 which, in the radial direction, defines a maximum outer bush diameter $D_{RB,max}$ and, in the axial direction, a maximum axial bush dimension $H_{RB,max}$.

In the present example, the bush 122.1, in the axial direction, reaches up to the spring body cavity 120.7, such that proper reinforcement of the sensitive central section 120.2 is achieved. Furthermore, the bush 122.1, in the axial direction, forms an axial passage through the central section 120.2 which is radially and axially substantially centrally located. By this means, the comparatively lightweight configuration may be achieved. In the present example, the bush 122.1, at its outer circumference, is firmly connected to the spring body 120.1.

The dimensions of the bush 122.1 are adapted to the specific mechanical properties of the spring device 120 to be achieved by selecting the following dimensions. The maximum outer bush diameter $D_{RB,max}$ is 98% of the maximum spring body cavity diameter $D_{SBC,max}$. In addition, the maximum axial bush dimension $H_{RB,max}$ is 49% of the maximum axial spring body dimension $H_{SB,max}$ in the axial direction.

Furthermore, the inner reinforcement unit 122 comprises a ring shaped reinforcement plate element 122.2, mainly extending in the radial direction and defining, in the radial direction, a maximum outer reinforcement plate diameter $D_{RP,max}$. In the present example, the maximum outer reinforcement plate diameter $D_{RP,max}$ is 89% of the maximum spring body diameter $D_{SB,max}$.

The reinforcement plate element 122.2 is a single reinforcement element firmly connected, in the radial direction, to the reinforcement bush 122.1. In the present example, the reinforcement plate element is axially centrally located in the area of the radial protrusion 120.6. The reinforcement plate element 122.2 is substantially fully embedded in the spring body 120.1, thereby achieving corrosion protection on the reinforcement plate element 122.2.

Furthermore, in the present example, the reinforcement unit 122 is made from a metal, thereby achieving simple and inexpensive reinforcement. A particularly lightweight design is achieved using an aluminum (Al) material for the reinforcement unit 122.

The end sections 120.3 of the spring body 120.1 are covered by a support plate element 123 providing an interface that is easily handled during manufacture of the vehicle 101. Each support plate element 123 comprises a centering section 123.1 axially protruding into the spring body cavities 120.7, thereby achieving a proper interface to the adjacent vehicle component. Furthermore, in the present example, each of the end sections 120.3 has an embedded ring shaped reinforcement component 124 located close to the outer end surface 120.4. In the present example, a metal, namely an aluminum (Al) material, is chosen for the support plate element 123 and the embedded reinforcement component 124.

As can be seen from FIG. 1, the wagon body 101.1 (more precisely, either the same part of the wagon body 101.1 also supported on the first running gear 102 or another part of the wagon body 101) is supported on a further, second running gear 116. The second running gear 116 is identical to the first running the 102 in all the parts described above. However, while the first running gear 102 is a driven running gear with a drive unit (not shown) mounted to the frame body 107, the second running gear 116 is a non-driven running gear, having no such drive unit mounted to the frame body 107.

Hence, according to a further aspect of the present invention, the frame body 107 forms a standardized component which used for both, the first running gear 102 and the second running gear, i.e. different types of running gear. Customization of the respective frame body 107 to the specific type of running gear type may be achieved by additional type specific components mounted to the standardized frame body 107. Such an approach is highly advantageous in terms of its commercial impact. This is due to the fact that, in addition to the considerable savings achieved due to the automated casting process, only one single type of frame body 107 has to be manufactured, which brings along a further considerable reduction in costs.

It should again be noted in this context that customization of the running gear 102, 116 to a specific type or function on the basis of identical frame bodies 107 is not limited to a differentiation in terms of driven and non-driven running gears. Any other functional components (such as e.g. specific types of brakes, tilt systems, rolling support systems, etc.) may be used to achieve a corresponding functional differentiation between such running gears on the basis of standardized identical frame bodies 107.

Although the present invention in the foregoing has only a described in the context of low-floor rail vehicles, it will be appreciated, however, that it may also be applied to any other type of rail vehicle in order to overcome similar problems with respect to a simple solution for reducing the manufacturing effort.

The invention claimed is:

1. A rail vehicle unit, comprising a running gear and a wagon body unit forming two contact partners and defining a longitudinal direction, a transverse direction and a height direction;

said wagon body unit being supported on said running gear via a suspension device;

a first rotational buffer device and a second rotational buffer device being associated to said running gear and said wagon body unit;

said first rotational buffer device and said second rotational buffer device being adapted to damp a rotational motion between said running gear and said wagon body unit about a rotational axis parallel to said height direction;

wherein said first rotational buffer device and said second rotational buffer device are configured to form a traction link between said running gear and said wagon body unit;

said traction link being configured to transmit at least a major fraction of a total traction force to be transmitted along said longitudinal direction between said running gear and said wagon body unit;

at least one of said first rotational buffer device and said second rotational buffer device is connected to a first contact partner of said two contact partners;

at least one of said first rotational buffer device and said second rotational buffer device having a first contact surface;

a second contact surface being formed at a second contact partner of said two contact partners;

said first contact surface and said second contact surface being configured to contact each other to transmit said fraction of said total traction force between said running gear and said wagon body unit; and said first contact surface and said second contact surface, in a neutral state of said rail vehicle unit, being separated by a longitudinal gap having a longitudinal gap dimension in said longitudinal direction.

2. The rail vehicle unit according to claim 1, wherein said traction link is configured to transmit at least 50% of a remaining fraction of said total traction force;

said remaining fraction being a difference between said total traction force and a suspension fraction of said total traction force transmitted by said suspension device along said longitudinal direction.

3. The rail vehicle unit according to claim 2, wherein said longitudinal gap dimension, in particular, is less than 3 mm;

wherein said first contact partner is said running gear, and wherein said second contact partner is said wagon body unit.

4. The rail vehicle unit according to claim 1, wherein said running gear comprises a frame body supported on at least one wheel unit via a primary suspension device and two wheel bearing units, each associated to one wheel of said wheel unit;

said wheel unit defining a track width in said transverse direction and a traction force plane, said traction force plane, in a neutral state of said rail vehicle unit, extending through a wheel to rail contact point of one of said wheels and being perpendicular to said transverse direction;

said wheel unit defining a bearing center width between centers of said wheel bearing units in said transverse direction and a bearing center plane, said bearing center plane, in a neutral state of said rail vehicle unit, extending through said center of one of said wheel bearing units and being perpendicular to said transverse direction;

said first rotational buffer device having a volumetric center;

said volumetric center, in said transverse direction, having a transverse traction force plane distance with respect to said traction force plane, said traction force plane distance being less than 20% of said track width;

or said volumetric center, in said transverse direction, having a transverse bearing center plane distance with respect to said bearing center plane, said bearing center plane distance being less than 20% of said bearing center width.

5. The rail vehicle unit according to claim 1, wherein said running gear comprises a frame body having a first longitudinal beam, a second longitudinal beam and a transverse beam unit providing a structural connection between said longitudinal beams in said transverse direction, such that a substantially H-shaped configuration is formed;

said first rotational buffer device being spatially associated to said first longitudinal beam;

said first rotational buffer device being spatially associated to an end section of said first longitudinal beam;

said first rotational buffer device being connected to a first rotational buffer interface section of said first longitudinal beam, said first rotational buffer interface section, in said longitudinal direction, facing towards a center of said running gear;

said second rotational buffer device being spatially associated to one of said first longitudinal beam and said second longitudinal beam;

said second rotational buffer device being spatially associated to an end section of one of said first longitudinal beam and said second longitudinal beam;

said second rotational buffer device being connected to a second rotational buffer interface section of one of said first longitudinal beam and said second longitudinal beam, said second rotational buffer interface section, in said longitudinal direction, facing towards a center of said running gear.

6. The rail vehicle unit according to claim 1, wherein a third rotational buffer device and a fourth rotational buffer device are provided;

said third rotational buffer device and said fourth rotational buffer device being configured to form a further traction link between said running gear and said wagon body unit;

said further traction link being configured to transmit at least a major fraction of a total traction force to be transmitted along said longitudinal direction between said running gear and said wagon body unit.

7. The rail vehicle unit according to claim 1, wherein said first rotational buffer device and said second rotational buffer device are spaced in said longitudinal direction or said first rotational buffer device and said second rotational buffer device are spaced in said transverse direction.

8. The rail vehicle unit according to claim 3, wherein at least one of said first rotational buffer device and said second rotational buffer device is adapted to restrict motion between said contact partners in said longitudinal direction while allowing motion between said contact partners in said transverse direction or at least one transverse buffer device is provided, said transverse buffer device restricting motion between said contact partners in said transverse direction; said at least one transverse buffer device being associated to a transverse beam unit of said running gear.

9. The rail vehicle unit according to claim 1, wherein at least one of said first rotational buffer devices comprises a buffer unit with a first support component, a second support component and at least one buffer component;

said at least one buffer component, in a support direction parallel to said longitudinal direction, being arranged between said first support component and said second support component;

said at least one buffer component being adapted to damp a motion between said first support component and said second support component in said support direction;

said at least one buffer component comprising at least one plastic material.

10. The rail vehicle unit according to claim 9, wherein at least one of said first support component, said second support component and said at least one buffer component comprises a substantially disc-shaped element or a substantially ring-shaped element defining a radial direction, said radial direction running transverse to said support direction;

said disc-shaped element having a dimension in said radial direction that is larger than its dimension in said support direction.

11. The rail vehicle unit according to claim 10, wherein said buffer unit has a maximum buffer length in said support direction and a maximum buffer diameter in a radial direction running transverse to said support direction;

said maximum buffer diameter being 160% to 280% of said maximum buffer length;

said at least one buffer component having a maximum buffer component length in said support direction and a maximum buffer component diameter in said radial direction;

said maximum buffer component diameter being 260% to 380% of said maximum buffer component length.

12. The rail vehicle unit according to claim 9, wherein said buffer unit comprises a guide device;

said guide device restricting motion between said first support component and said second support component in a radial direction running transverse to said support direction;

said guide device comprising a piston element connected to said first support component and a cylinder element connected to said second support component;

said piston element being adapted to plunge into said cylinder element in said support direction and to cooperate with said cylinder element in said radial direction for restricting motion in said radial direction;

said piston element, in an unloaded state of said buffer unit having a radial play in said radial direction with respect to said cylinder element;

at least one of said piston element and said cylinder element protruding into a centrally located recess of said at least one buffer component;

at least one of said piston element and said cylinder element comprising at least one centering section protruding into a centrally located recess of said at least one buffer component.

13. The rail vehicle unit according to claim 9, wherein said buffer unit comprises a hard stop arrangement;

said hard stop arrangement restricting motion between said first support component and said second support component in said support direction;

said hard stop arrangement being integrated into a guide device of said buffer unit restricting motion between said first support component and said second support component in a radial direction running transverse to said support direction.

14. The rail vehicle unit according to claim 5, wherein two of said rotational buffer devices are arranged to be spaced and substantially in line with each other in said longitudinal direction;

two of said rotational buffer devices being arranged to be substantially in line with at least one suspension element of said suspension device in said longitudinal direction, said at least one suspension element being located between said two rotational buffer devices;

two of said rotational buffer devices being substantially located in a common plane with a central longitudinal axis defined by a longitudinally central section of one of said longitudinal beams, said common plane being perpendicular to said transverse direction.

15. The rail vehicle unit according to claim 1, wherein said wagon body unit is a wagon body or a bolster connected to a wagon body;

said wagon body, in said longitudinal direction, having a wagon body length which is selected such that, during an operation of said rail vehicle unit on a track network having a radius of track curvature, and a maximum angular deflection of said wagon body with respect to said running gear about said rotational axis from a neutral, undeflected state is at most 4°;

or said wagon body, in said longitudinal direction, having a wagon body length which is 300% to 1000% of a wheel unit distance of two wheel units of said running gear in said longitudinal direction.

16. A running gear for a rail vehicle, wherein said running gear is configured as the running gear of a rail vehicle unit of claim 1.

* * * * *